US009221156B2

(12) United States Patent
Bachman et al.

(10) Patent No.: US 9,221,156 B2
(45) Date of Patent: Dec. 29, 2015

(54) MOTORIZED HAND TOOL APPARATUS AND ASSEMBLY METHOD

(71) Applicant: Snap-on Incorporated, Kenosha, WI (US)

(72) Inventors: Jose R Bachman, Blairsville, GA (US); Kenneth C Happ, Burlington, WI (US); Joshua M Beer, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 328 days.

(21) Appl. No.: 13/894,710

(22) Filed: May 15, 2013

(65) Prior Publication Data

US 2014/0338502 A1 Nov. 20, 2014

(51) Int. Cl.
*B25B 21/00* (2006.01)
*B25F 5/02* (2006.01)

(52) U.S. Cl.
CPC ..... *B25B 21/004* (2013.01); *B25F 5/02* (2013.01); *Y10T 29/49815* (2015.01); *Y10T 29/49826* (2015.01)

(58) Field of Classification Search
CPC ..... B25B 1/001; B25B 23/0007; B25F 5/02; Y10T 29/49947
See application file for complete search history.

(56) References Cited

U.S. PATENT DOCUMENTS

| | | | | |
|---|---|---|---|---|
| 6,039,126 | A | 3/2000 | Hsieh | |
| 6,915,721 | B2 * | 7/2005 | Hsu et al. | 81/57.13 |
| 7,735,398 | B2 * | 6/2010 | Hsu et al. | 81/57.39 |
| 2003/0121676 | A1 * | 7/2003 | Ortt et al. | 173/1 |
| 2007/0251711 | A1 | 11/2007 | Chen | |
| 2008/0190246 | A1 * | 8/2008 | Hsu et al. | 81/57.13 |
| 2011/0265958 | A1 * | 11/2011 | Skinner et al. | 160/127 |
| 2012/0090863 | A1 * | 4/2012 | Puzio et al. | 173/2 |
| 2012/0187782 | A1 * | 7/2012 | Esenwein | 310/43 |
| 2013/0025900 | A1 * | 1/2013 | Kokinelis et al. | 173/216 |
| 2013/0134009 | A1 * | 5/2013 | Mueller | 192/112 |
| 2014/0157961 | A1 * | 6/2014 | Chen | 81/464 |

FOREIGN PATENT DOCUMENTS

| | | |
|---|---|---|
| CN | 102781630 A | 11/2012 |
| GB | 248231 | 3/1926 |
| GB | 2415652 A | 1/2006 |

OTHER PUBLICATIONS

Combined Search and Examination Report for GB 1407728.3, dated Sep. 2, 2014.
Australian Government, Patent Examination Report No. 1, dated Jul. 1, 2015; 6 pages.
State Intellectual Property Office of P.R.China, First Office Action dated Aug. 3, 2015 with English translation; 9 pages.

* cited by examiner

*Primary Examiner* — David B Thomas
(74) *Attorney, Agent, or Firm* — Seyfarth Shaw LLP

(57) ABSTRACT

A motorized hand tool such as a cordless ratchet wrench is configured for reducing assembly and disassembly processes. The motorized hand tool includes a motor end plate that may be fastened to a drive member such as a ratchet head assembly without the use of fasteners or assembly tooling such as presses, fixtures or hammers. A flange on the motor end plate can pass through a keyway in a periphery of the ratchet head assembly and may be then be rotated out of the keyway and into a peripheral slot of the ratchet head assembly. A rib protruding inwardly from a clamshell housing portion of the tool closes the keyway to prevent the flange on the motor end plate from rotating back into the keyway.

14 Claims, 6 Drawing Sheets

MOTORIZED HAND TOOL APPARATUS AND ASSEMBLY METHOD

TECHNICAL FIELD OF THE INVENTION

The present application relates to a motorized hand tool for applying torque to a work piece. More particularly, the present application relates to a motor coupling to a head assembly of a motorized hand tool.

BACKGROUND OF THE INVENTION

Power hand tools such as motorized ratchet wrenches and drivers are commonly used in automotive, industrial and household applications to install and remove threaded fasteners and to apply a torque and/or angular displacement to a work piece such as a threaded fastener, for example. Motorized hand tools such as cordless power ratchets and drivers generally include an electric motor contained in a clamshell housing along with other components such as switches, light emitting diodes (LEDs), and batteries, for example. The clamshell housing generally includes two or more housing portions fastened together by fasteners such as screws or rivets.

The process of assembling a motor subassembly to a drive member such as a ratchet head housing in a motorized hand tool generally involves the use elaborate fixtures, presses and/or hammers, for example. Current process for assembling a motor subassembly to a ratchet housing involve fastening a motor end plate to a ratchet head housing with fasteners such as pins or screws. Manufacturing tooling including presses, fixtures and hammers are used to install the fasteners. Disassembly of the ratchet heads housing from the motor end plate involves the use of a hammer and punch to remove the fasteners. The resulting subassemblies have been difficult to disassemble without causing damage to its constituent components.

SUMMARY OF THE INVENTION

According to embodiments of the present application, a motorized hand tool such as a cordless ratchet wrench includes a motor end plate that may be fastened to a drive member such as a ratchet head assembly without the use of fasteners or assembly tooling such as presses, fixtures or hammers. A flange on the motor end plate can pass through a keyway in a periphery of the ratchet head assembly and may then be rotated out of the keyway and into a peripheral slot of the ratchet head assembly. In one example, the motor end plate compresses a compressible member such as a rubber O-ring or steel wave washer to absorb clearance tolerances and provide a tight fit.

The motor end plate may be assembled from the keyway into the slot by applying a 90 degree rotation of the motor end plate relative to the ratchet head assembly around a main axis of the motorized hand tool to secure a motor assembly to the ratchet head assembly. A clamshell housing assembled around the motor assembly includes an inwardly protruding rib portion that substantially fills the keyway and prevents the motor end plate from rotating back out of the slot.

The motor assembly may be disassembled from the ratchet head assembly by removing the clamshell housing and by applying a 90 degree rotation of the motor end plate relative to the ratchet head assembly around the main axis of the motorized hand tool so that the flange of the motor end plate is aligned to clear the keyway.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1A:
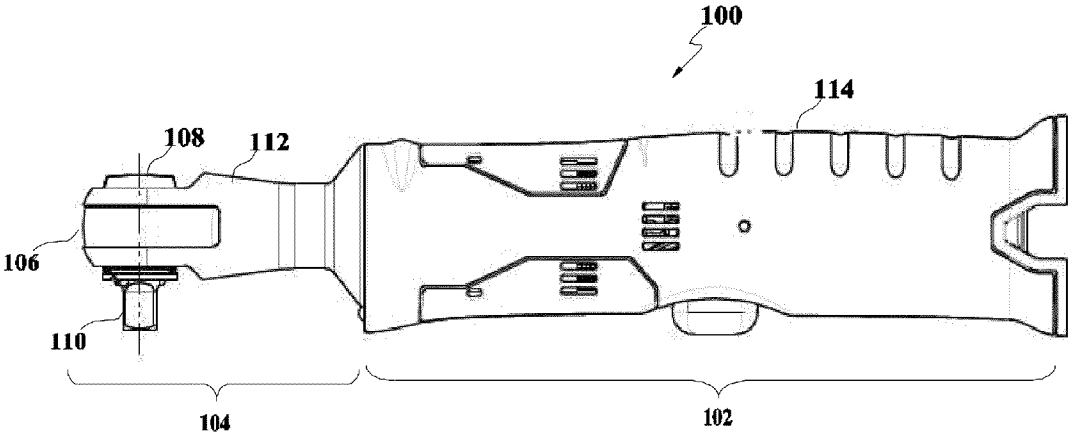
FIG. 1A is a side view drawing illustrating a cordless ratchet tool including a ratchet head assembly coupled to a motor assembly in accordance with an embodiment of the present application.

It should be understood that the comments included in the specification as well as the materials, dimensions and tolerances discussed therein are simply proposals such that one skilled in the art would be able to modify the proposals within the scope of the present application.

DETAILED DESCRIPTION OF THE EMBODIMENTS

While this invention is susceptible of embodiments in many different forms, there is shown in the drawings, and will herein be described in detail, a preferred embodiment of the invention with the understanding that the present application is to be considered as an exemplification of the principles of the invention and is not intended to limit the broad aspect of the invention to embodiments illustrated.

Figure 1B:
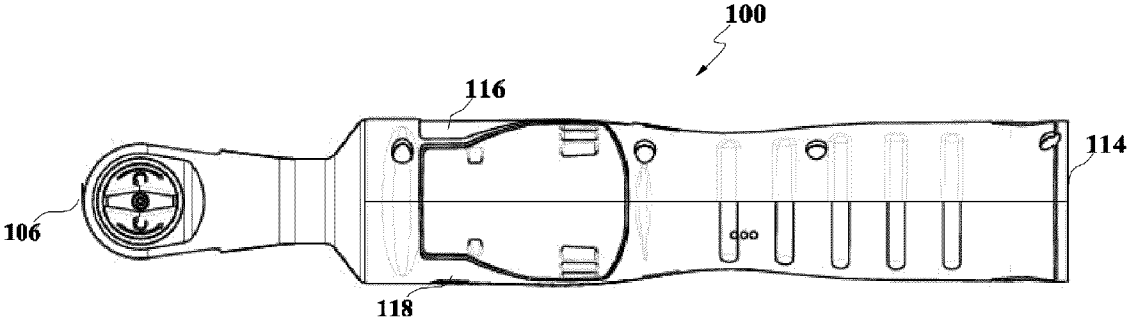
FIG. 1B is a top view drawing illustrating a cordless ratchet tool including a ratchet head assembly coupled to a motor assembly in accordance with an embodiment of the present application.

Embodiments of the present application may be implemented in a motorized hand tool such as the cordless ratchet tool shown in FIG. 1A The cordless ratchet tool 100 includes a handle portion 102 coupled to a driver portion 104 The driver portion 104 may include a ratchet head assembly 106 including a ratchet housing 112, ratchet head 110, and selector knob 108, for example. The handle portion 102 may include a main housing 114 enclosing an electric motor, a switch assembly and one or more status indicators such as light emitting diodes, for example. FIG. 1B shows a top view of the cordless ratchet tool 100. Referring to FIG. 1B, the main housing 114 may be assembled from two or more clamshell housing portions 116, 118 fastened together and securely attached to the ratchet head assembly 104.

Figure 2:
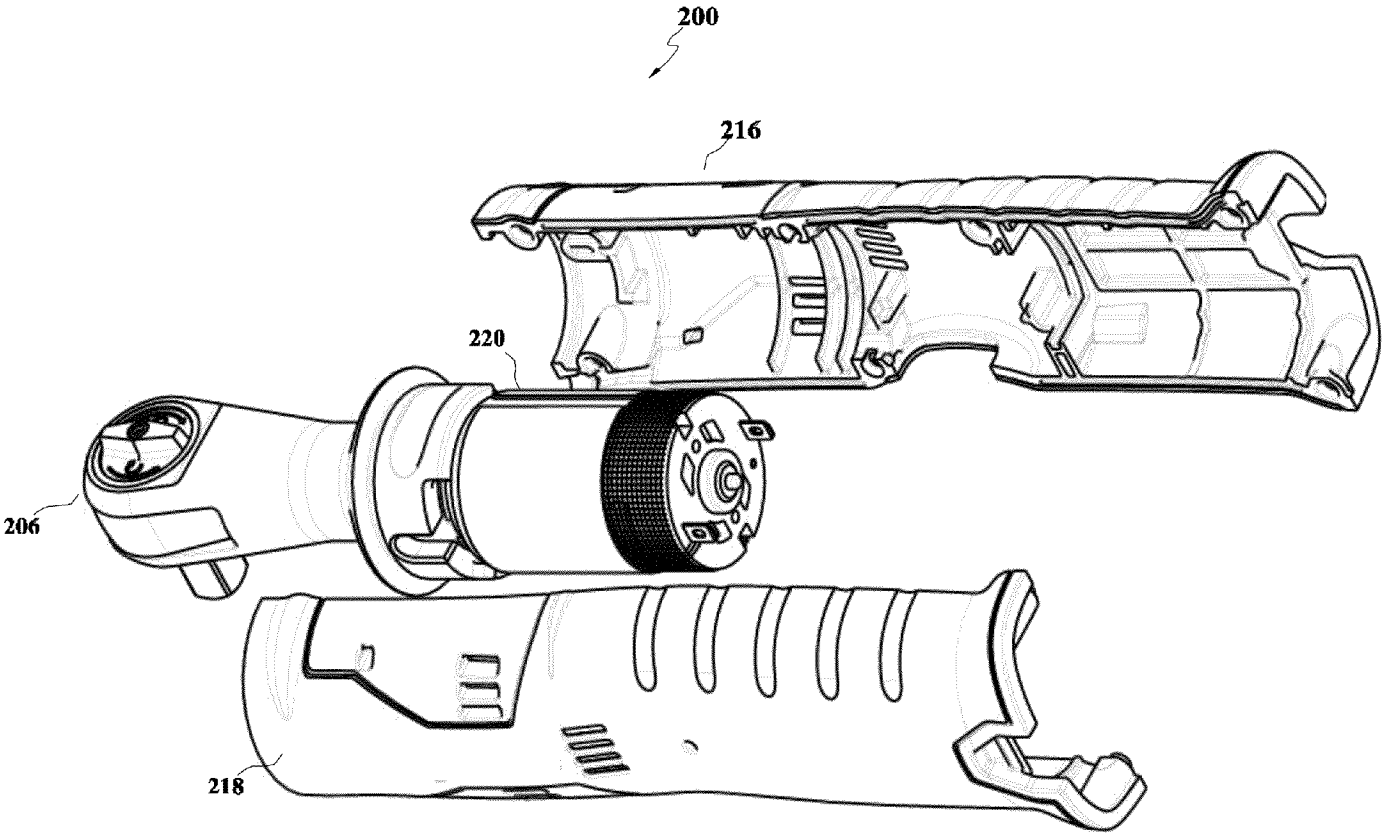
FIG. 2 is an exploded view drawing of a ratchet head, motor and clamshell housing assembly of a cordless ratchet tool in accordance with an embodiment of the present application.

FIG. 2 shows a ratchet head assembly 206 of a cordless ratchet tool assembly 200 coupled to a motor assembly 220 according to an aspect of the present application. A first clamshell housing portion 216 and second clamshell housing portion 218 of the cordless ratchet tool assembly 200 are configured for assembly around the motor assembly 220 and the ratchet head assembly 206.

Figure 3:
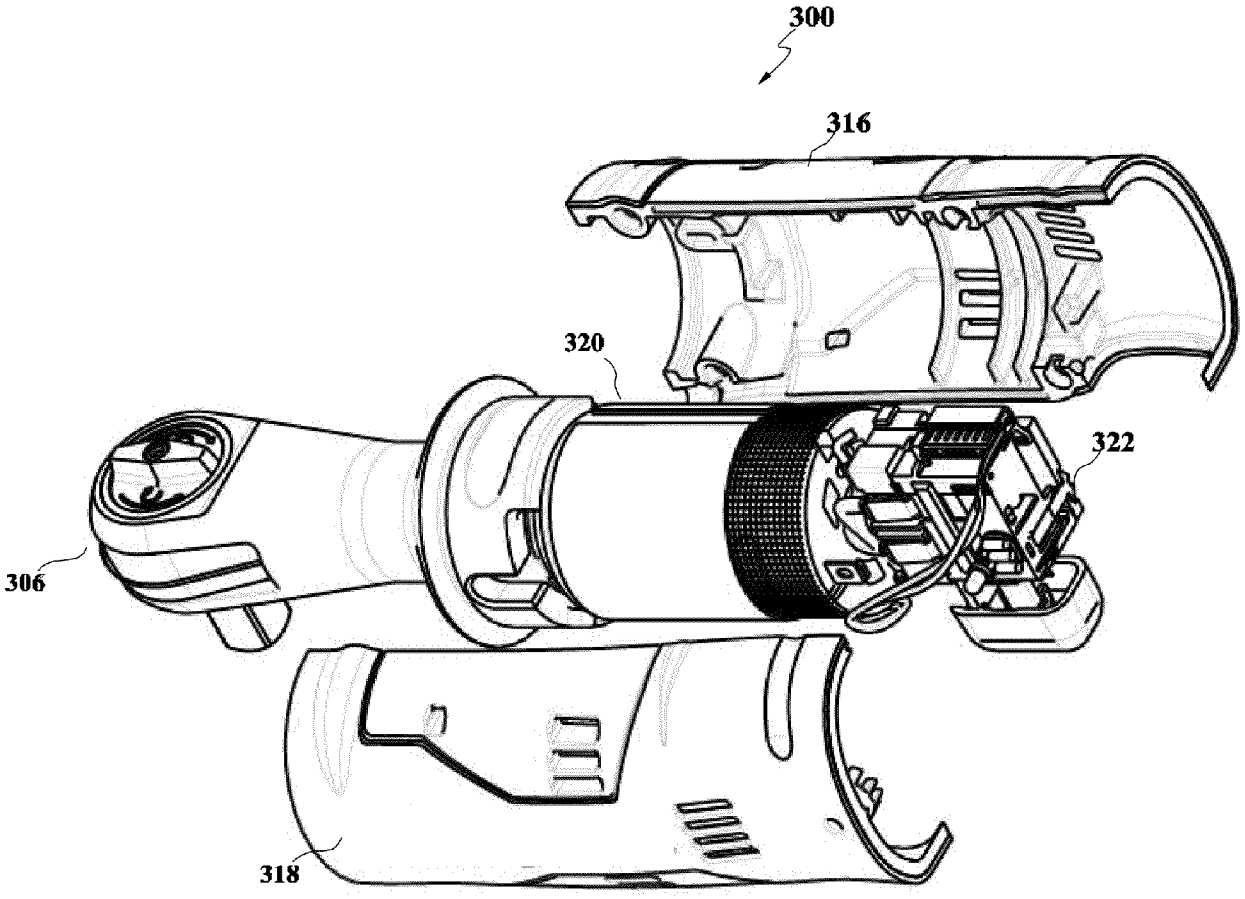
FIG. 3 is an exploded view drawing of a ratchet head, motor, switch and clamshell housing assembly of a cordless ratchet tool in accordance with an embodiment of the present application.
Figure 4A:
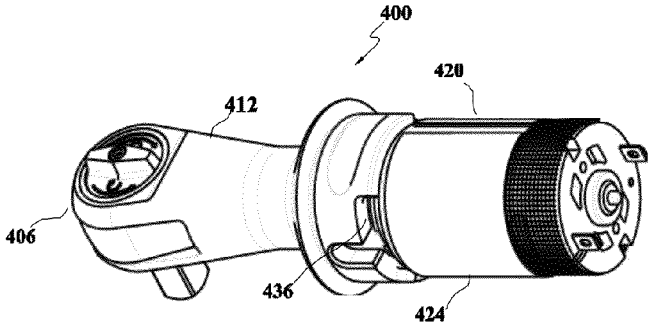
FIG. 4A is an illustration of a ratchet head and motor subassembly of a cordless ratchet tool in accordance with an embodiment of the present application.
Figure 4B:
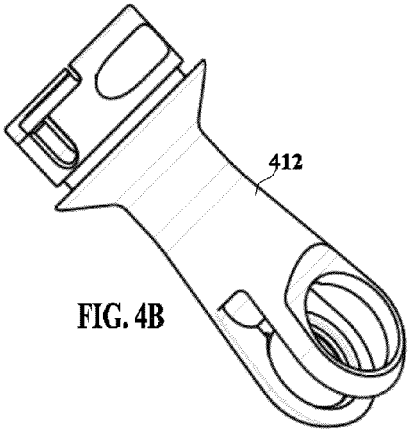
FIG. 4B is an illustration of a ratchet head housing of a cordless ratchet tool in accordance with an embodiment of the present application.
Figure 4C:
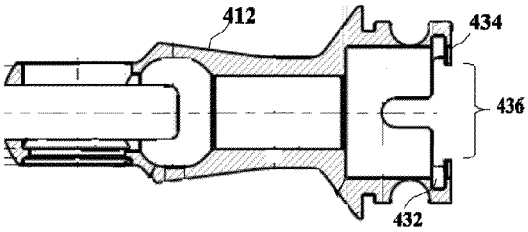
FIG. 4C is a cross sectional view of a ratchet head housing of a cordless ratchet tool in accordance with an embodiment of the present application.
Figure 4D:
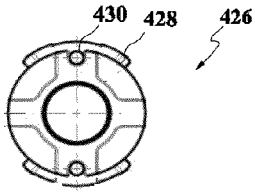
FIG. 4D is an illustration of a motor end plate of a cordless ratchet tool in accordance with an embodiment of the present application.

FIG. 3 shows a ratchet head assembly 306 of a cordless ratchet tool assembly 300 coupled to a motor assembly 320 and a switch assembly 322 according to another aspect of the present application. A first clamshell housing portion 316 and second clamshell housing portion 318 of the cordless ratchet tool assembly 300 are configured for assembly around the motor assembly 320.

A ratchet head and motor subassembly 400 according to an aspect of the present application is described with reference to FIGS. 4A-4D. The ratchet head and motor subassembly 400 shown in FIG. 4A includes a motor assembly 420 coupled to a ratchet head assembly 406. The motor assembly 420 includes an electric motor 420 coupled to a motor end plate such as the motor end plate 424 shown in FIG. 4D.

The motor end plate 426 may be fastened to the electric motor 424 by fasteners such as rivets or screws through fastener holes 430, for example. According to an aspect of the present application, the motor end plate 426 includes one or more outwardly protruding semi-annular flanges 428. The flanges 428 are configured to fit in a semi-annular slot 432 formed by an undercut behind a lip 434 around a periphery in the ratchet head housing 412. One or more discontinuities in the lip 434 create one or more apertures 436 that are sized to receive each of the one or more flanges 428 of the motor end plate 426 during assembly of the motor end plate 426 to the ratchet head housing 412 and during disassembly of the motor end plate 426 from the ratchet head housing 412. The motor end plate 426, may also include one or more detent structures (not shown) configured to provide tactile indications of proper rotation displacement during assembly.

According to aspects of the present application, the motor assembly 420 is coupled to the ratchet head housing 412 by pushing the flanges 428 of the motor end plate 426 through the apertures 436 in the lip 434 of the ratchet head housing 412 then rotating the motor assembly 420 relative to the ratchet head housing 412 until the flanges 428 of the motor end plate 426 are secured in the semi-annular slot 432 of the ratchet head housing 412. In one example, the flanges 428 and apertures 436 are sized so that the motor assembly 420 may be rotated in 90 degrees in either direction to engage the semi-annular slots 432 of the ratchet head housing 412 during an assembly process or to disengage the semi-annular slots 432 of the ratchet head housing during a disassembly process. A compressible member (not shown) such as a steel wave washer or an O-ring made from a compressible material such as rubber, or other elastomer, for example, may be installed between the motor assembly 420 and the ratchet head housing 412 to absorb dimensional tolerances. The compressible member is compressed during assembly of the motor assembly 420 to the ratchet head housing 412 and provides pressure between the flange 428 and lip 434 that facilitates a tight fit and alignment of drive gears, for example.

Figure 5:
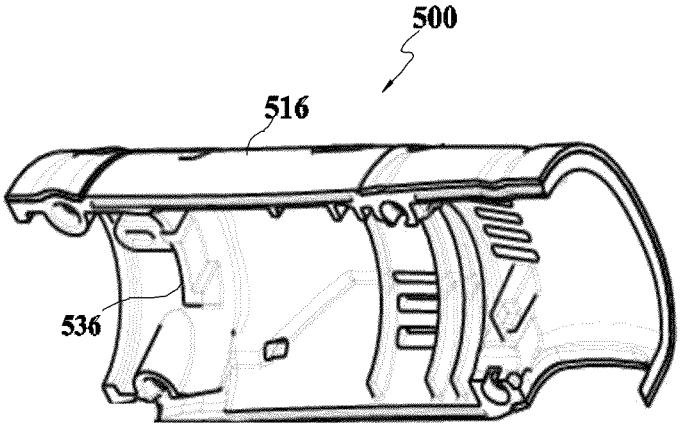
FIG. 5 is an illustration of a clamshell housing portion in accordance with an embodiment of the present application.

According to another aspect of the present application, a rib protruding inwardly from one or more clamshell housing portions is shaped to substantially fill the one or more apertures 436 when the clam shell housing is assembled to the ratchet head and motor subassembly 400. Referring to FIG. 5, one or more semi-annular ribs 536 in a first clamshell housing portion 516 are shaped to fit into and substantially fill the one or more apertures 436, for example. The semi-annular ribs 536 prevent the motor end plate 426 from rotating out of the slot 432 in the ratchet head housing 412.

Figure 6:
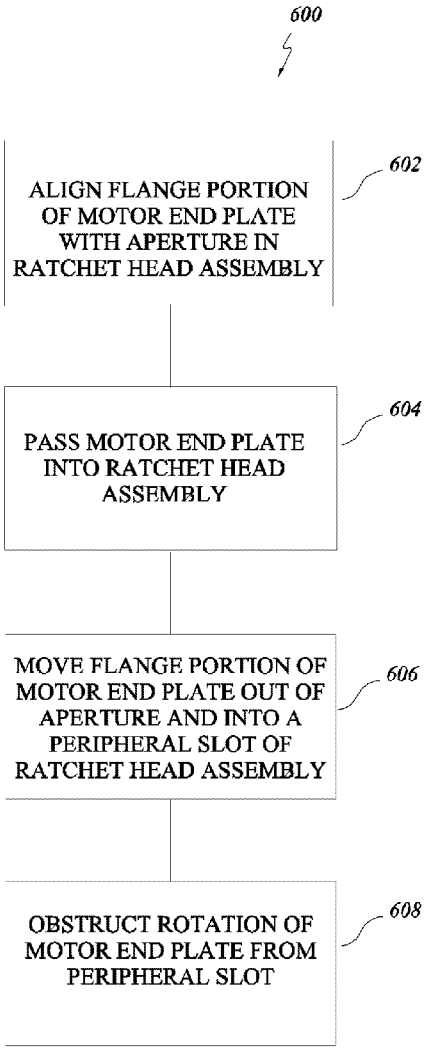
FIG. 6 is a process flow diagram illustrating a method of assembling a cordless ratchet tool in accordance with an embodiment of the present application.

FIG. 6 is a process flow diagram illustrating a process 600 for assembling a motorized hand tool according to an aspect of the present application. As shown, the process 600 begins and proceeds to step 602, which includes aligning a semi-annular flange portion of a motor end plate with an aperture in a ratchet head assembly. In step 604, the process includes passing a motor end plate into the ratchet head assembly after aligning the semi-annular flange portion. In step 606, the process includes moving the semi-annular flange portion out of the aperture and into a peripheral slot of the ratchet head assembly by rotating the motor end plate. In step 608, the process includes obstructing rotation of the motor end plate from the peripheral slot.

According to an aspect of the present application, an inwardly protruding rib portion of a clamshell housing may be aligned with the aperture. The rib portion may be placed in the aperture to assemble the clamshell housing around the ratchet head assembly so that the rib portion obstructs rotation of the motor end plate from the peripheral slot.

Figure 7:
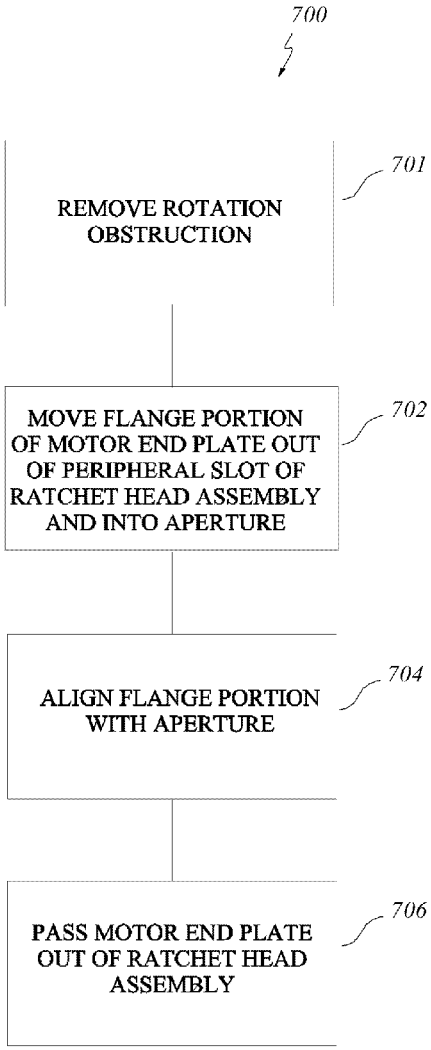
FIG. 7 is a process flow diagram illustrating a method of disassembling a cordless ratchet tool in accordance with an embodiment of the present application.

FIG. 7 is a process flow diagram illustrating a process 700 for assembling a motorized hand tool according to an aspect of the present application. As shown, the disassembly process 700 begins and proceeds to step 701, which includes removing a member obstructing rotation of a motor end plate. In step 702, the process includes moving a semi-annular flange portion of a motor end plate out of a peripheral slot of a ratchet head assembly and into an aperture in the ratchet head assembly by rotating the motor end plate. In block 704, the disassembly process includes aligning the semi-annular flange portion of a motor end plate with the aperture. In block 706, the disassembly process includes passing a motor end plate out of the ratchet head assembly after aligning the semi-annular flange portion. According to an aspect of the present application, the disassembly process may also include opening the aperture by removing a clamshell housing portion from around the ratchet head housing before rotating the motor end plate housing.

As discussed above, the aspects of the present application are described in terms of a cordless ratchet tool 100 as shown in FIG. 1. However, it should be understood that aspects of the present application could be implanted in other motorized hand tools. For example, and without limitation, the motorized hand tool can be ratchet wrench, open wrench, screw driver, nut driver, or any other tool capable of applying torque to a work piece.

As used herein, the term "coupled" or "communicably coupled" can mean any physical, electrical, magnetic, or other connection, either direct or indirect, between two parties. The term "coupled" is not limited to a fixed direct coupling between two entities.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A motorized hand tool apparatus, comprising:

a motor assembly including a motor end plate coupled to a motor, the motor assembly further including a flange portion;

a ratchet head assembly coupled to the motor assembly, the ratchet head assembly including a slot defined by a lip disposed around a first peripheral segment of the ratchet head assembly, the slot sized to engage the flange portion, and an aperture defined by an interruption in the lip around a second peripheral segment of the ratchet head assembly, the aperture sized to provide a keyway for inserting the flange portion into the slot; and a clamshell housing assembled around the motor assembly, the clamshell housing including an inwardly protruding rib portion engaged in the aperture and obstructing rotation of the flange from the slot.

2. The motorized hand tool apparatus of claim 1, further comprising:

a compressible member disposed between the motor assembly and the ratchet head assembly.

3. The motorized hand tool apparatus of claim 1:

wherein the flange portion includes:

opposing first and second semi-annular flanges, each having a flange thickness and a flange arc length; and wherein the slot includes:

first and second slot portions, each having a slot arc length about equal to the flange arc length.

4. The motorized hand tool apparatus of claim 3, wherein the motor end plate includes:

a first diameter across the flange portion; and a second diameter less than the first diameter between the first semi-annular flange and the second semi-annular flange.

5. The motorized hand tool of claim 1, wherein the motor end plate includes at least one flange detent configured for engaging a corresponding detent structure in the ratchet head assembly.

6. The motorized hand tool of claim 1, wherein the clamshell housing includes first and second clamshell housing portions fastened together and disposed around the motor assembly.

7. The motorized hand tool of claim 1, further comprising:

a second aperture defined by a second interruption in the lip around a second peripheral segment of the ratchet head assembly, the second aperture sized to provide a keyway for a second flange of the motor end plate; and the second clamshell housing portion comprising a second inwardly protruding rib portion engaged in the aperture.

8. The motorized hand tool of claim 1, wherein the motor assembly includes an electric motor coupled to the motor end plate.

9. A method of assembling a motorized hand tool apparatus, comprising:

aligning a semi-annular flange portion of a motor end plate with an aperture in a ratchet head assembly;

after aligning the semi-annular flange portion, rotating the motor end plate into the ratchet head assembly wherein the semi-annular flange portion is disposed underneath a lip of the ratchet head assembly;

aligning an inwardly protruding rib portion of a clamshell housing with the aperture; and placing the rib portion in the aperture to assemble the clamshell housing around the ratchet head assembly, the rib portion obstructing rotation of the motor end plate from the peripheral slot.

10. The method of claim 9, further comprising:

fastening the motor end plate to an electric motor.

11. The method of claim 9, further comprising:

compressing a compressible member between the motor end plate and the ratchet head assembly.

12. A method of disassembling a motorized hand tool apparatus, comprising:

removing a clamshell housing to thereby remove a rib of the clamshell housing from an aperture and allow rotation of a semi-annular flange portion of a motor end plate within a peripheral slot of a ratchet head housing;

rotating a motor end plate to thereby move the semi-annular flange portion of the motor end plate out of the peripheral slot and into the aperture;

aligning the semi-annular flange portion and the aperture; and after aligning the semi-annular flange portion, passing the motor end plate out of the ratchet head assembly.

13. A motorized cordless ratchet wrench, comprising:

a motor assembly;

a ratchet head assembly coupled to the motor assembly a steel wave washer disposed between the motor assembly and the ratchet head assembly; and a clamshell housing assembled around the motor assembly;

wherein the motor assembly includes:

a motor end plate coupled to a motor and includes a flange portion;

wherein the ratchet head assembly includes:

a slot defined by a lip around a first peripheral segment of the ratchet head assembly, the slot sized to engage the flange portion;

an aperture defined by an interruption in the lip around a second peripheral segment of the ratchet head assembly, the aperture sized to provide a keyway for assembling the flange portion into the slot;

wherein the clamshell housing includes:

an inwardly protruding rib portion engaged in the aperture and obstructing rotation of the flange from the slot;

wherein the flange portion includes:

first and second semi-annular flanges, each having a flange thickness and a flange arc length; and wherein the slot includes:

first and second slot portions, each having a slot arc length about equal to the flange arc length.

14. The motorized cordless ratchet wrench of claim 13, further comprising:

a second aperture defined by a second interruption in the lip around a second peripheral segment of the ratchet head assembly, the second aperture sized to provide a keyway for a second flange of the motor end plate; and the second clamshell housing portion including a second inwardly protruding rib portion engaged in the aperture.

* * * * *